US005111187A

United States Patent [19]

Heckleman et al.

[11] Patent Number: 5,111,187

[45] Date of Patent: May 5, 1992

[54] PERSONAL SECURITY SYSTEM NETWORK WITH FALSE ALARM PREVENTION

[75] Inventors: Todd E. Heckleman, Hamlin; Daniel F. Pedtke, Palmyra, both of N.Y.

[73] Assignee: Detection Systems, Inc., Fairport, N.Y.

[21] Appl. No.: 726,363

[22] Filed: Jul. 5, 1991

[51] Int. Cl.[5] ..... G08B 25/00

[52] U.S. Cl. ..... 340/574; 455/100; 455/115; 455/117; 340/527; 340/539

[58] Field of Search ..... 340/574, 539, 527; 455/100, 115, 117

[56] References Cited

U.S. PATENT DOCUMENTS 4,998,095 3/1991 Shields ..... 340/574

*Primary Examiner*—Glen R. Swann, III

[57] ABSTRACT

A personal security system includes at least one movable transmitter adapted to produce an emergency signal transmission when activated and a plurality of transceivers adapted to receive emergency signal transmissions from the movable transmitter. False alarms are avoided by inhibiting multiple transmissions by a movable transmitter within a predetermined time period.

8 Claims, 2 Drawing Sheets

PERSONAL SECURITY SYSTEM NETWORK WITH FALSE ALARM PREVENTION

BACKGROUND OF THE INVENTION

1. Field of the invention

The present invention relates to a network of transceivers which monitor a defined geographic area for the receipt of transmissions indicative of emergency situations, and which relay an alarm signal to a central station for appropriate action. More particularly, the present invention is directed to an improved portable transmitter for such transceiver networks wherein false alarms are inhibited by limiting the transmitter to a single use within a predetermined time period.

2. Description of the Prior Art

Emergency transmitter systems are known in the art. U.S. Pat. No. 4,998,095, which issued to N. G. Shields on Mar. 5, 1991, describes an emergency transmitter system for individuals within a predetermined geographic area such as a campus, shopping mall, or stadium. A plurality of fixed transceivers at selected locations in the area monitor radio frequency emergency transmissions from portable transmitters. To avoid false alarms, Shields provides a single-use portable transmitter that requires a reset by security personel. The requirement for reset would be an inconvenience, necessitating the user to travel to the security office for reset. Also, if the security office is not open at the time, as might likely be the situation if a reset was required between closing on Friday evening and re-opening on Monday morning, there would be an extended time period when the user was unprotected.

SUMMARY OF THE INVENTION

According to the present invention, a portable transmitter as described herein is adapted to inhibit multiple transmissions within a predetermined time period.

According to another feature of the present invention a portable transmitter includes a timer which is set upon transmission of an emergency signal, and which prevents re-transmission of an emergency signal until the timer times out.

According to still another feature of the present invention, a portable transmitter of the type described cannot produce multiple transmissions within a predetermined time period, and the transmitter is automatically reset upon expiration of the time period.

According to yet another feature of the present invention, the initiation of the time period during which re-transmission is prevented may be delayed to permit re-transmission to thereby insure that the signal has been received.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
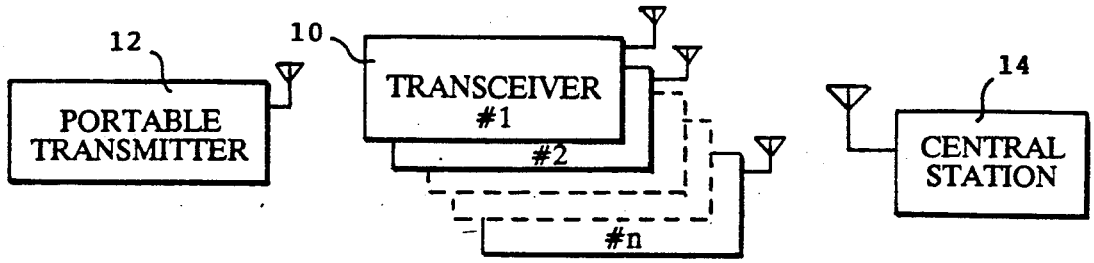
FIG. 1 is a schematic representation of a geographic area provided with the personal security system network of the present invention.

Referring to FIG. 1, a personal security system network according to one embodiment of the present invention includes a plurality of fixed transceivers 10 located in a predetermined pattern within a geographic area, such as for example on utility poles, sides of buildings, etc. Also shown in FIG. 1 is a portable transmitter 12 that can be carried by an person and activated to produce a radio frequency emergency signal transmission to be picked up by the fixed transceivers. The signal strength of the emergency signal received by each transceiver 10 is generally inversely related to the distance of the transceiver from the portable transmitter. A central station receiver 14 monitors alarm signals from the transceivers. Additional details of transceiver 10 and the security system network can be found in commonly assigned, co-pending U.S. patent application Ser. No. 07/726,362 entitled PERSONAL SECURITY SYSTEM NETWORK filed concurrently herewith in the names of K. Kostusiak et al., the disclosure of which is specifically incorporated herein by reference.

Figure 2:
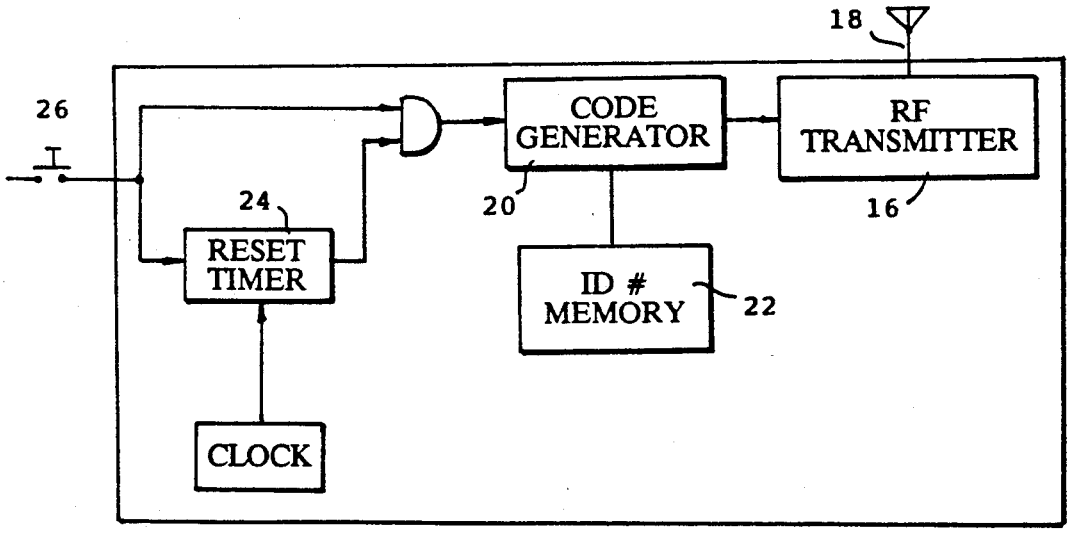
FIG. 2 is a block diagram of a portable transmitter as shown in FIG. 1.

Referring to FIG. 2, portable transmitter 12 consists of a radio frequency (RF) transmitter 16, an antenna 18, a personal identification code generator 20 with associated memory 22, an inhibit timer 24, and a switch or push button 26 to activate the portable transmitter. The function of code generator 20 may be derrived from a microprocessor if desired. When the push button is activated, transmitter 16 broadcasts the identification code provided by code generator 20. At that time, timer 24 is reset to inhibit any additional transmission until the timer is timed out. Note that as shown, the inhibit timer output is high when the timer is timed out and goes low when the timer is reset.

Figure 3:
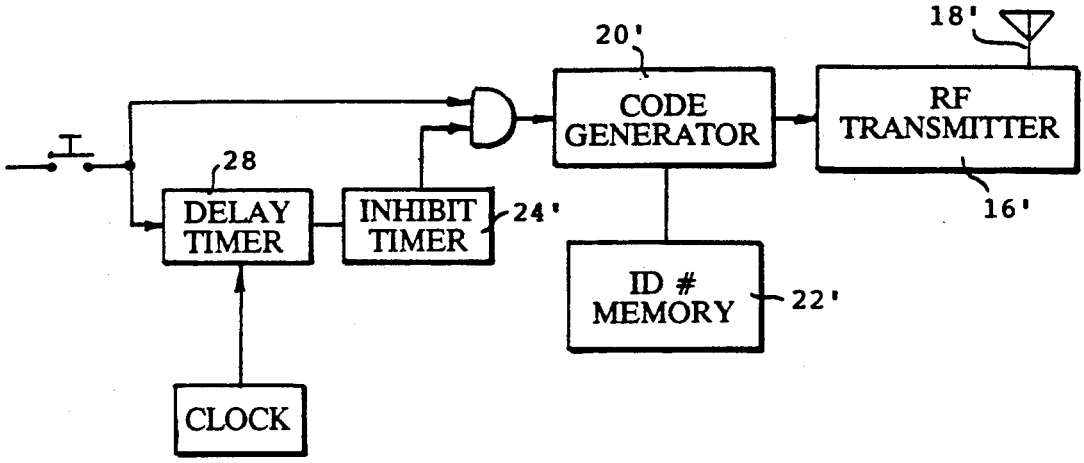
FIG. 3 is a block diagram of another embodiment of the portable transmitter as shown in FIG. 1.

In another embodiment of the present invention as illustrated in FIG. 3, portable transmitter 12' consists of a radio frequency (RF) transmitter 16', an antenna 18', a personal identification code generator 20' with associated memory 22', a non-resetable inhibit delay timer 28, an inhibit timer 24', and a switch or push button 26' to activate the portable transmitter. When the push button is activated, transmitter 16' broadcasts the identification code provided by code generator 20'.

Figure 4:
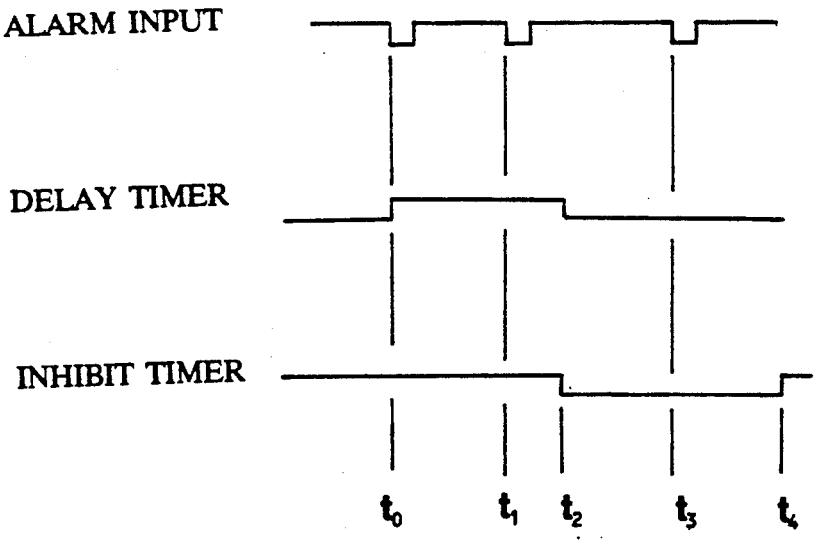
FIG. 4 is a timing chart for a portable transmitter as shown in FIG. 1.

Referring to the timing diagram of FIG. 4, when the pushbutton is activated at time $t_0$, transmitter 16' broadcasts the identification code provided by code generator 20'. Also at time $t_0$, delay timer 28 is started. If the alarm input button is activated again at some time $t_1$ before time $t_2$, another alarm transmission will be caused, but the delay timer will not be restarted and keeps running for a predetermined time period. At time $t_2$, the delay timer times out, activating inhibit timer 24'. The inhibit timer inhibits further activations of the transmitter until time $t_4$. During the period between $t_2$ and $t_4$, further activations of the alarm button, as at $t_3$, do not trigger a transmission. When the inhibit time expires at $t_4$, alarms are again allowed.

The emergency signal transmission from an activated portable transmitter 12 or 12' is picked up by all transceivers 10 that are within radio range of the transmitter. Emergency signals transmitted from a portable transmitter are likely to reach more than one transceiver. Each receiving transceiver will transmit a relay signal, and at least one transceiver, as determined by the above-identified co-pending application, will go into an alarm state; activating the local alarm and initiating a message to central station receiver 14. The alarm message includes (1) the code from the portable transmitter, (2) an amplitude code, and (3) a transceiver identification code.

The invention has been described in detail with particular reference to preferred embodiments thereof, but it will be understood that variations and modifications can be effected within the spirit and scope of the invention.

What is claimed is:

1. A portable transmitter for use with a personal security system; said transmitter comprising:

means for transmitting an emergency signal; and means for inhibiting multiple transmissions within a predetermined time period.

2. A portable transmitter as set forth in claim 1 wherein said inhibiting means comprises:

a timer which is set upon transmission of an emergency signal; and means for inhibiting transmission of an emergency signal when said timer is set.

3. A portable transmitter as set forth in claim 2 wherein said timer is adapted to time out in said predetermined time period, whereby another emergency signal may then be transmitted.

4. A portable transmitter as set forth in claim 1 wherein said inhibiting means comprises:

a timer which is set upon expiration of a predetermined delay following transmission of an emergency signal; and means for inhibiting transmission of an emergency signal when said timer is set.

5. A combination comprising:

a central station for monitoring alarm signals;

a network of transceivers adapted to receive emergency signals, and to transmit alarm signals to said central station upon receipt of an emergency signal; and at least one portable transmitter for transmitting an emergency signal, said portable transmitter including means for inhibiting multiple transmissions within a predetermined time period.

6. A combination as set forth in claim 5 wherein said inhibiting means comprises:

a timer which is set upon transmission of an emergency signal; and means for inhibiting transmission of an emergency signal when said timer is set.

7. A portable transmitter as set forth in claim 6 wherein said timer is adapted to time out in said predetermined time period, whereby another emergency signal may then be transmitted.

8. A portable transmitter as set forth in claim 5 wherein said inhibiting means comprises:

a timer which is set upon expiration of a predetermined delay following transmission of an emergency signal; and means for inhibiting transmission of an emergency signal when said timer is set.

* * * * *